United States Patent [19]

Barth

[11] Patent Number: 4,883,188

[45] Date of Patent: Nov. 28, 1989

[54] CONTAINER WITH BASE CUP AND PROJECTION TO LIMIT STACKING OF BASE CUPS

[75] Inventor: John M. Barth, Saline, Mich.

[73] Assignee: Hoover Universal, Inc., Ann Arbor, Mich.

[21] Appl. No.: 114,092

[22] Filed: Oct. 27, 1987

Related U.S. Application Data

[63] Continuation-in-part of Ser. No. 934,340, Nov. 24, 1986, abandoned.

[51] Int. Cl.[4] ..... B65D 23/08; B65D 21/02

[52] U.S. Cl. ..... 215/12.1; 215/1 C; 215/100 R; 206/519; 220/69

[58] Field of Search ..... 215/1 C, 12.1, 100 R, 215/10; 248/346; 220/69; 206/519, 520, 499, 505, 515; 229/1.5 B; D 9/369

[56] References Cited

U.S. PATENT DOCUMENTS

| | | | |
|---|---|---|---|
| D. 216,615 | 2/1970 | Lawton | D9/369 X |
| 3,123,273 | 3/1964 | Miller | 229/1.5 B |
| 3,327,895 | 6/1967 | Mueller | 206/519 |
| 3,836,042 | 9/1974 | Petitto | 229/1.5 B X |
| 3,927,782 | 12/1975 | Edwards | 215/12.1 X |
| 4,111,303 | 9/1978 | Compton | 206/519 X |
| 4,241,839 | 12/1980 | Alberghini | 215/12.1 X |
| 4,293,359 | 10/1981 | Jakobsen | 215/1 C X |
| 4,326,638 | 4/1982 | Nickel et al. | 215/12.1 |
| 4,438,856 | 3/1984 | Chang | 215/12.1 |
| 4,463,860 | 8/1984 | Yoshino et al. | 215/100 R |

*Primary Examiner*—Sue A. Weaver

*Attorney, Agent, or Firm*—Harness, Dickey & Pierce

[57] ABSTRACT

According to the preferred embodiment of the present invention, a method and apparatus for forming base cups for plastic bottles is disclosed wherein a hollow body is blow molded and then cut in half to form two base cups. The side wall of the body is molded with a pair of outwardly extending projections such that when stacking a plurality of base cups, the projection of one cup engages the top lip of the adjacent lower cup thereby making denesting of the top easier.

5 Claims, 8 Drawing Sheets

CONTAINER WITH BASE CUP AND PROJECTION TO LIMIT STACKING OF BASE CUPS

CROSS REFERENCE TO RELATED APPLICATION

This application is continuation-in-part of application Ser. No. 934,340 filed Nov. 24, 1986, now abandoned.

BACKGROUND AND SUMMARY OF THE INVENTION

Since the widespread acceptance by consumers of blow molded PET containers for carbonated beverages, efforts have been made by the bottling industry to improve the containers. Many of such containers are composites, consisting of a blow molded bottle and a supporting base cup. Many efforts have concentrated on improving the bottle but few improvements have involved the base cup of the bottle.

Base cups have generally been made using injection molding techniques which implicitly impose some disciplines on the shape of the injection molded article. For example, projections and overhangs can not readily be formed on the sidewalls of an injection molded article. In addition, the weight of the base cup can only be reduced a certain amount because of the flow characteristics of the plastic during the injection molding steps.

It is an object of the present invention, therefore, to provide a base cup container consisting of a blow molded bottle and a blow molded base cup.

A further object of the present invention is to provide an improved method and apparatus for manufacturing the base cup container.

SUMMARY OF THE INVENTION

The base cup of this invention consists of a blow molded article having a irregularly shaped base and an upstanding annular wall which terminates in an inwardly directed lip. The lip is intended to engage the side wall of the blow molded bottle in a fluid tight relation so as to prevent water or other washing fluid used in the bottling process from accumulating inside the base cup. The base cup also includes drain openings in the base so that in the event any water flows past the lip into the base cup it will be automatically drained from the base cup through the drain openings.

The base cup is formed by first blow molding a hollow body corresponding in the shape to the shape of two base cups secured in rim-to-rim engagement and then dividing the body along a line midway between the end walls and extending diametrically through the body side wall to thereby divide the body into two base cups. This procedure also enables the formation of a de-nesting projection or projections extending outwardly from the base cup side wall. During assembly of the container, a plurality of base cups are necessarily stacked and in the absence of a de-nesting ring or projection of some type on the base cups, it is difficult to disengage individual base cups from the stack.

In the present invention, de-nesting projections, which can take the form of a ring on the base cup side wall or can also take the form of embossments such as trademarks or other identifying indicia, are formed on the side wall of the base cup. Such projections are readily formed on a blow molded base cup, but not an injection molded base cup because of the problem of removing the base cup from the mold.

The blow molded body is readily formed with a groove at a position midway between the end walls and this groove can be conveniently slit to divide the body into two base cups, each of which has the above described inwardly extending lip at the upper end of the side wall.

The invention includes improved blow molding structure for forming the blow molded bodies in large numbers and body handling and slitting assemblies for dividing the bodies into two base cups.

The result is an improved base cup container which can be readily be manufactured in large numbers.

Further objects, features and advantages of the present invention will become apparent to one skilled in the art upon reading the following specification and by reference to the following drawings and claims.

Figure 1:
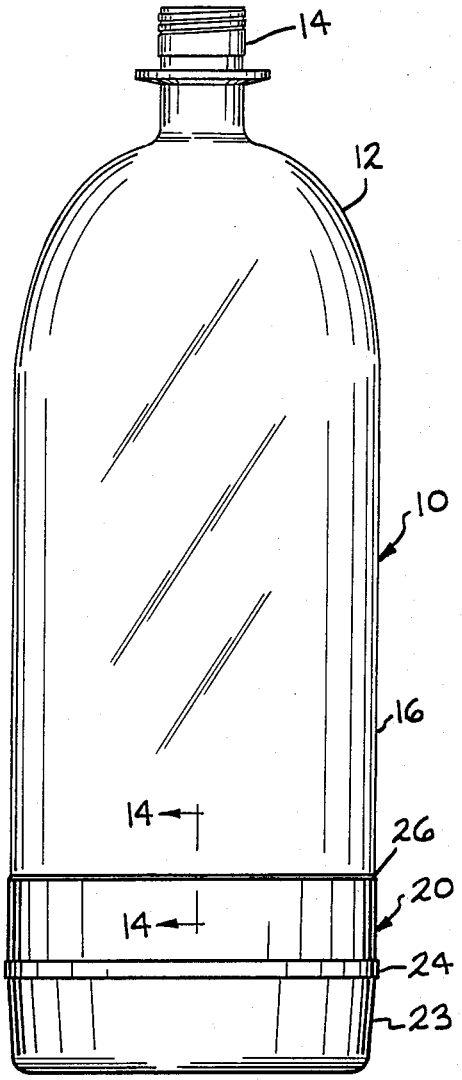
FIG. 1 is a side elevational view of the base cup container of this invention.
Figure 2:
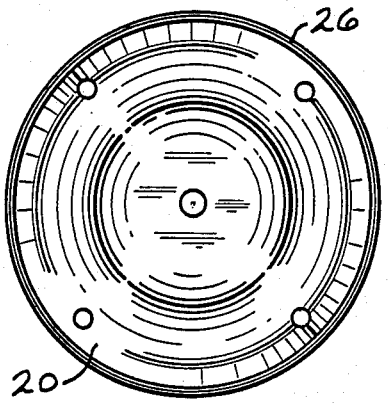
FIG. 2 is a top view of the base cup in the container shown in FIG. 1.
Figure 3:
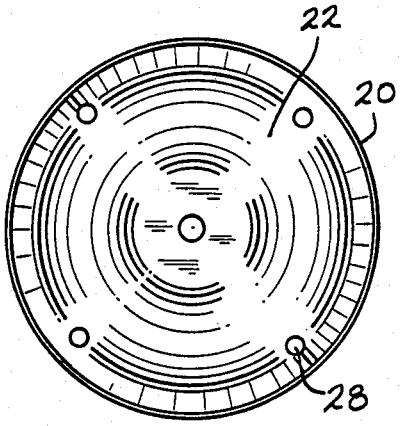
FIG. 3 is a bottom view of the base cup shown in FIG. 1.
Figure 4:
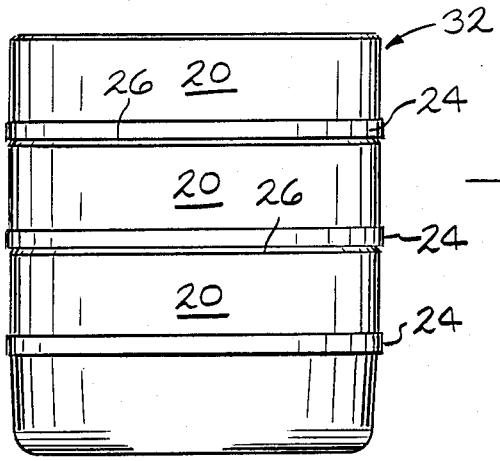
FIG. 4 is a side view of a stack of base cups constructed according to this invention.

With reference to the drawing, the base cup container of this invention, indicated generally at 10, is illustrated in FIG. 1 as including a conventional blow molded bottle 12 for carbonated beverages, formed most commonly of a clear PET material and having a threaded neck 14, a generally tubular body 16 and a rounded base 18 (FIG. 4). The container 12 is supported in a base cup 20 which is secured to the bottle base 18, usually by a liquid adhesive, and is capable of firmly supporting the composite container 10 on a horizontal surface. For this purpose, the base cup 20 has a bottom wall 22 which is shaped so that it has a plurality of points that are located in the same horizontal plane.

Figure 14:
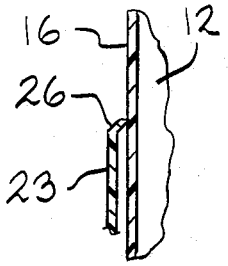
FIG. 14 is an enlarged fragmentary sectional view of a portion of the base cup container as seen from substantially the line 14—14 in FIG. 1.

The base cup 20 has an upwardly extending tubular side wall 23 and intermediate the upper and lower ends of the base cup, the side wall 23 is formed with an outwardly extending projection 24. In the form of the base cup illustrated in FIGS. 1–4A, inclusive, the projection 24 takes the form of an annular de-nesting ring 24 which extends continuously around the circumference of the upwardly extending tubular wall 23. At its upper end or rim, the wall 23 terminates in an upwardly and inwardly inclined annular sealing lip 26 which is engaged with the cylindrical side wall 16 of the bottle 12 (FIG. 14). The purpose of the lip 26 is to fluid seal the upper end of the base cup 20 to the bottle 12 to prevent the washing water or other fluid that is used to rinse the bottle 12 in the final stages of the bottling process from flowing into the base cup 20. The lip 26 functions to deflect water or other fluid flowing downwardly on the bottle wall 16 outwardly and down the outer surface of the base cup 20. In the event any of such water does enter the base cup 20, a plurality of openings 28 provided in the bottom wall 22 of the base cup 20 will drain the fluid out of the interior of the base cup 20 so as to maintain sanitary conditions around the composite container 10.

The de-nesting ring 24 functions, as illustrated in FIG. 4 which shows a plurality of base cups 20 in a stack 32, to facilitate one-by-one removal of base cups 20 from the stack 32. The base cups 20 are arranged in the stack 32 by telescoping the lower end of one base cup 20 into the top end of the base cup therebelow. This telescoping proceeds until the de-nesting ring 24 engages the lip 26 which functions as the top rim of the base cup 20. As shown in FIG. 4, the de-nesting ring 24 is of a larger diameter than the lip 26 so that it will engage the lip 26 to prevent further telescoping movement of the upper base cup into the lower base cup. The resulting is a stack 32 in which the base cups 20 can be readily removed one at a time from the stack to facilitate assembly of containers 12 and base cups 20.

Figure 6:
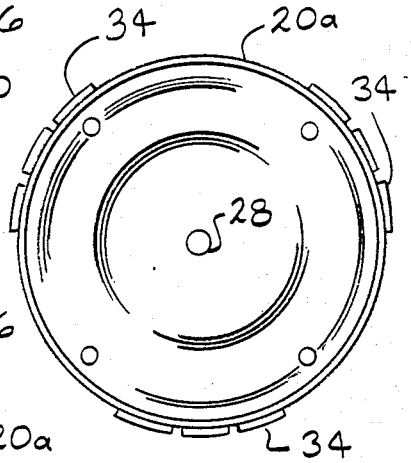
FIG. 6 is a top view of a base cup in the stack shown in FIG. 5.
Figure 5:
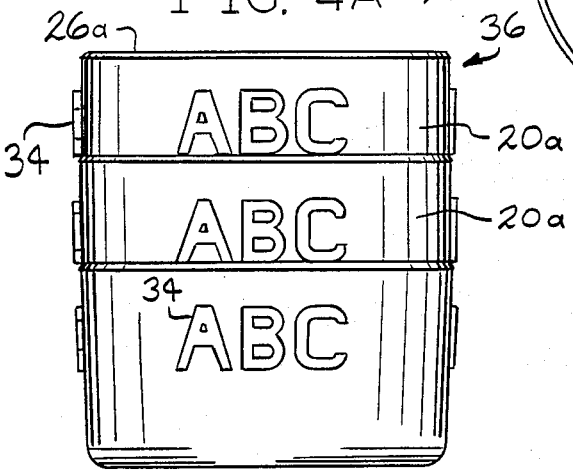
FIG. 5 is a side view of a stack of base cups illustrating a modified form of the base cup of this invention.

A modified form of the base cup 20, indicated generally at 20*a*, is illustrated in FIGS. 5 and 6. The base cup 20*a* is identical to the base cup 20 except for the form of the de-nesting projections on the side wall 23. In the base cup 20*a*, the projection midway between the upper and lower ends of the base cup sidewall 23 consists of embossments 34, illustrated diagramatically as the letters "A, B and C" which project outwardly from the sidewall 23. The embossments 34 project outwardly from the sidewall 23 at a plurality of positions around the circumference of the sidewall 23, preferably at equally spaced locations such as the three locations illustrated in FIG. 6 that are 120° apart.

The embossments 34, which can conveniently take the form of the trademark identifying the contents of the container 10, function like the de-nesting ring 24 to enable one-by-one removal of the base cups 20*a* from the stack 36 shown in FIG. 5. This is due to the fact that the projections 34 are located substantially midway between the upper end lower ends of the container sidewall 23 and engage the lip 26*a* at the upper rim of the base cup so as to limit the extent to which the base cups can be telescoped.

Figure 12:
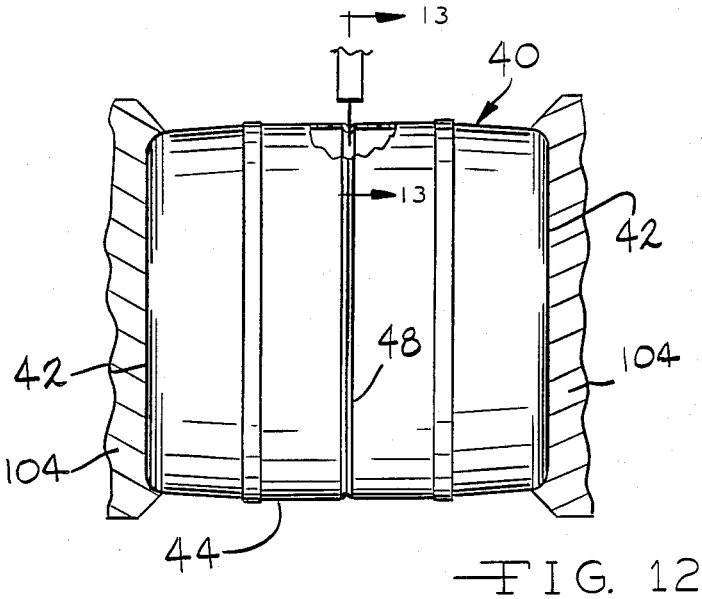
FIG. 12 is an enlarged view of a portion of the apparatus shown in FIGS. 10 and 11 illustrating a blow molded article in the process of being slit.
Figure 13:
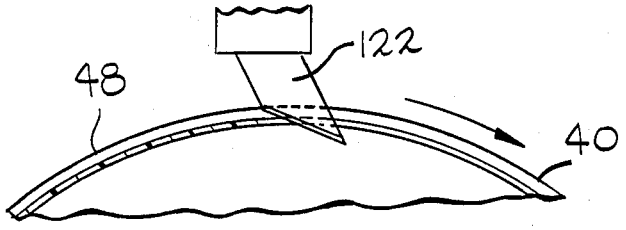
FIG. 13 is an end view of the apparatus shown in FIG. 12 showing the slitting knife in the process of slitting a blow molded article.

Since the base cups 20 and 20*a* are substantially identical, only the method and apparatus for forming the base cup 20 will be described in detail, it being understood that the cup 20*a* is formed by the same method and apparatus. The base cup 20 is made by first blow molding a hollow body 40, shown in FIGS. 9 and 12, which corresponds in shape to the shape of two of the base cups 20 secured in lip to lip engagement. The body 40 has end walls 42 corresponding to the base cup bottom walls 22 and a tubular sidewall corresponding to the base cup sidewalls 23. As shown particularly in FIG. 12*a*, the sidewall 44 has in inwardly extending V-shaped groove 48 midway between its ends.

Figure 7:
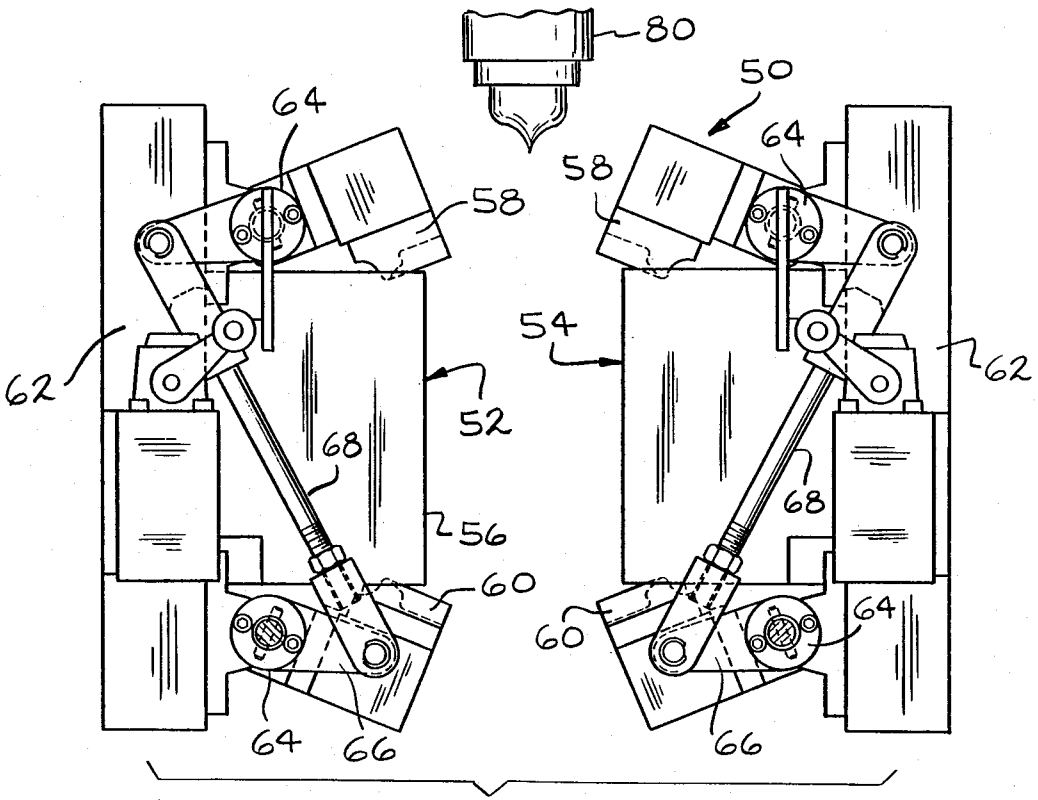
FIG. 7 is a side elevational view of a blow mold apparatus for forming the improved base cup of this invention, showing the blow mold apparatus in a "mold open" condition.
Figure 8:
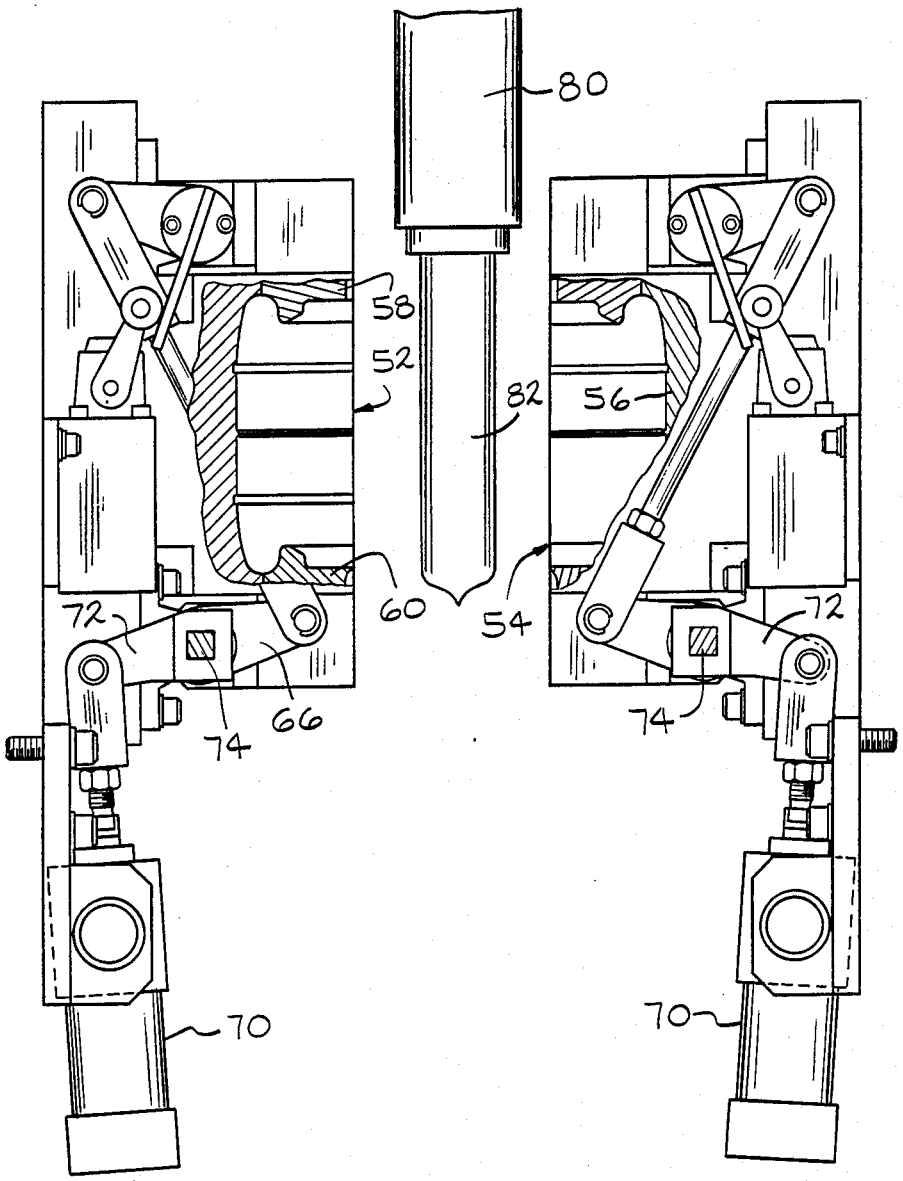
FIG. 8 is a side view of the mold apparatus of FIG. 7 showing the mold apparatus in an intermediate position between open and closed positions.
Figure 9:
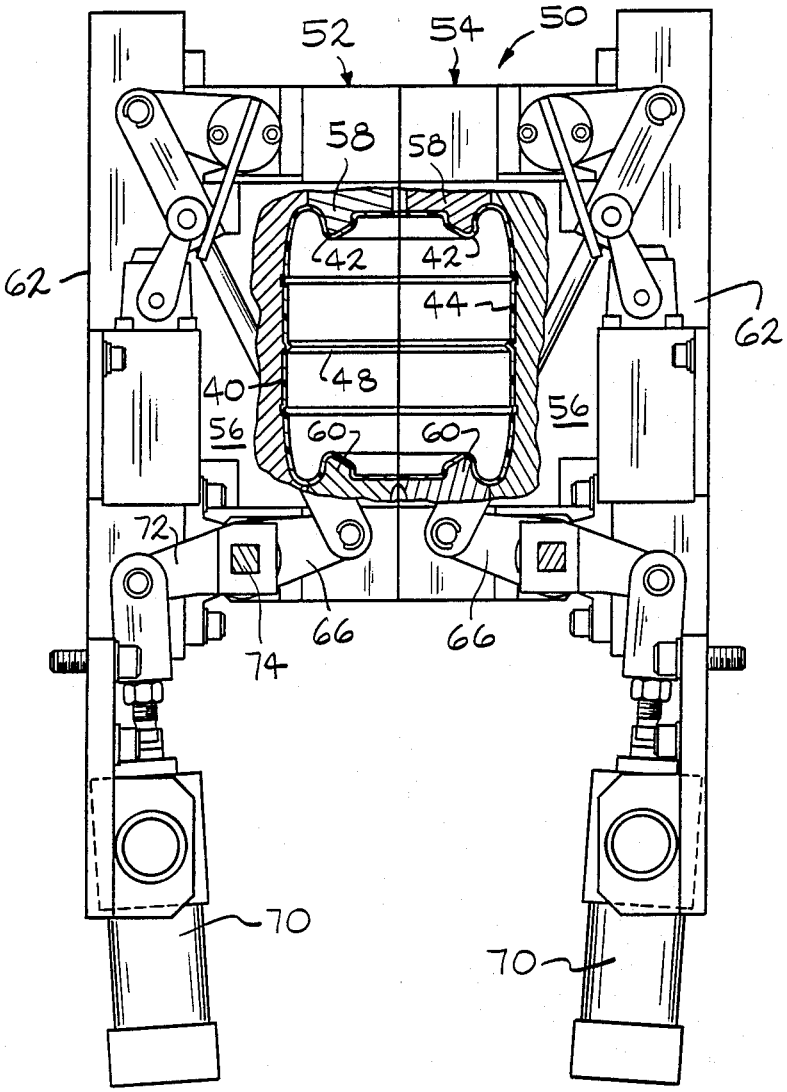
FIG. 9 is a side elevational view of the mold apparatus of FIGS. 7 and 8 showing the apparatus in the "mold closed" position.

The hollow body 40 is blow molded in the blow mold apparatus indicated generally at 50 in FIGS. 7, 8 and 9. The apparatus 50 is a multi-part blow mold assembly consisting of two halves 52 and 54 each of which has a main blow mold portion 56 corresponding to ½ the shape of the tubular sidewall 44. Each of the halves 52 and 54 also include top and bottom end portions 58 and 60, respectively, each of which corresponds to ½ of an end wall 42 of the body 40.

The main blow mold portions 56 are mounted on platens 62 which are movable toward and away from each other to close and open the blow mold, respectively, and the end portions 58 and 60 are mounted on pivot assemblies 64 carried by the platens 62.

In each of the mold half assemblies 52 and 54, the pivot assemblies 64 include actuating arms 66 which are connected together by an adjustable linkage assembly 68. As a result, when one of the arms 66 is rotated in one direction, both of the end mold sections 58 and 60 are moved toward the main mold section 56 and when the arm 66 is moved in the opposite direction the end mold sections 58 and 60 are moved away from the main mold section 56.

Cylinder assemblies 70, mounted on the platens 62, as shown in FIG. 8, are operatively connected to the lower arms 66, by means of crank arms 72 that are secured to the shafts 74 which are in turn also secured to the arms 66. Thus, when the cylinder assemblies 70 are retracted, the mold end sections 58 and 60 are concurrently moved from their open positions shown in FIG. 7 toward their closed positions in FIGS. 8 and 9. When the cylinder assemblies 70 are extended, the mold end sections 58 and 60 are moved from their closed positions shown in FIGS. 8 and 9 toward their open position shown in FIG. 7.

An extrusion head and blow pin assembly 80, which receives a supply of molten plastic material from a conventional plasticator (not shown) is operable to extrude a downwardly extending tubular parison 82 (FIG. 8) which is located between the mold halves 52 and 54 in the open position of the mold assembly illustrated in FIG. 8. The mold halves 52 and 54 then move to the closed position illustrated in FIG. 9, the parison 82 is expanded into conformity with the mold cavity and the body 40 is formed. The mold halves 52 and 54 are then moved toward their open positions shown in FIG. 8 and body 40 is removed and transferred to the conveyor 84 (FIG. 10) which delivers the body 40 to the slitter assembly indicated generally at 86.

Figure 10:
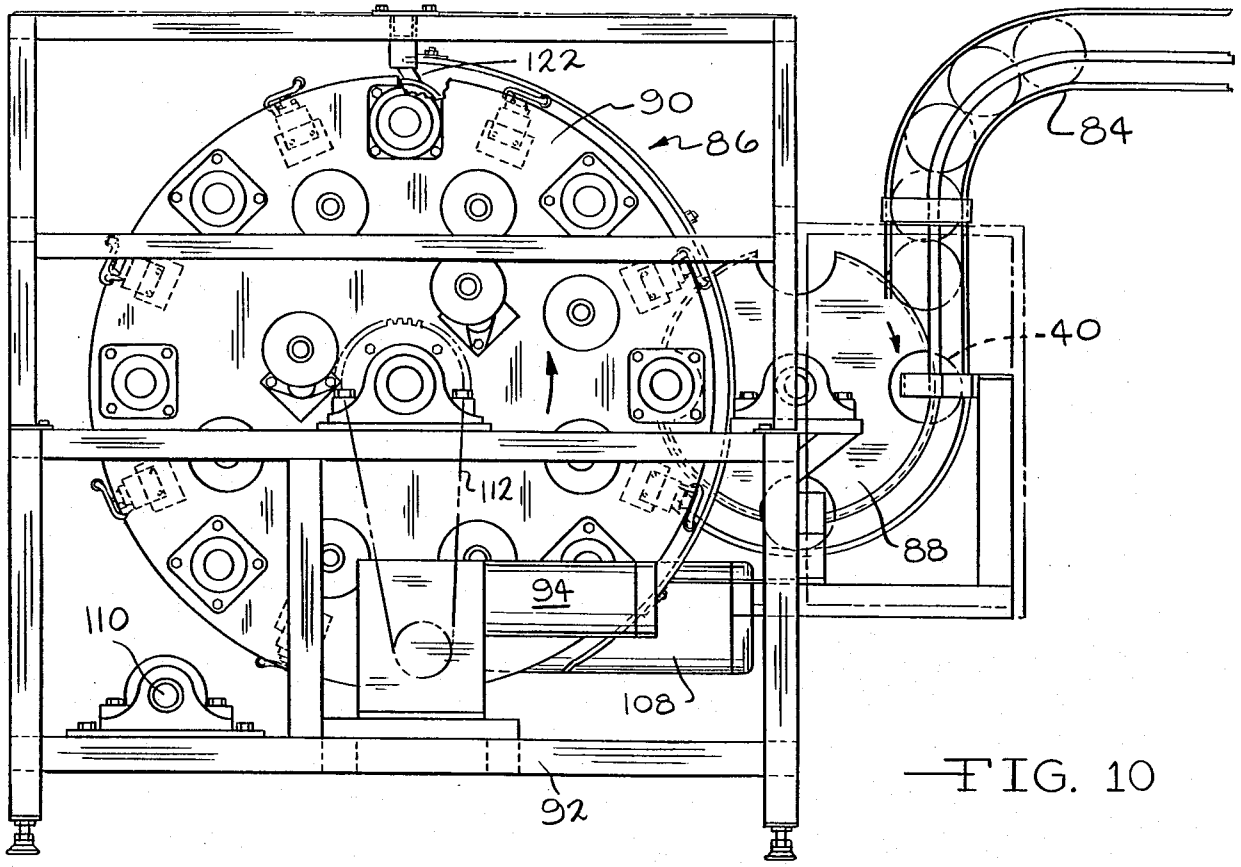
FIG. 10 is an elevational view of the apparatus of this invention for slitting the blow molded article to form pairs of base cups.

The slitter assembly 86 includes a feeder wheel 88 which rotates in a clockwise direction was viewed in FIG. 10 and a carrier wheel 90 which rotates in a counter clockwise direction as viewed in FIG. 10.

Figure 11:
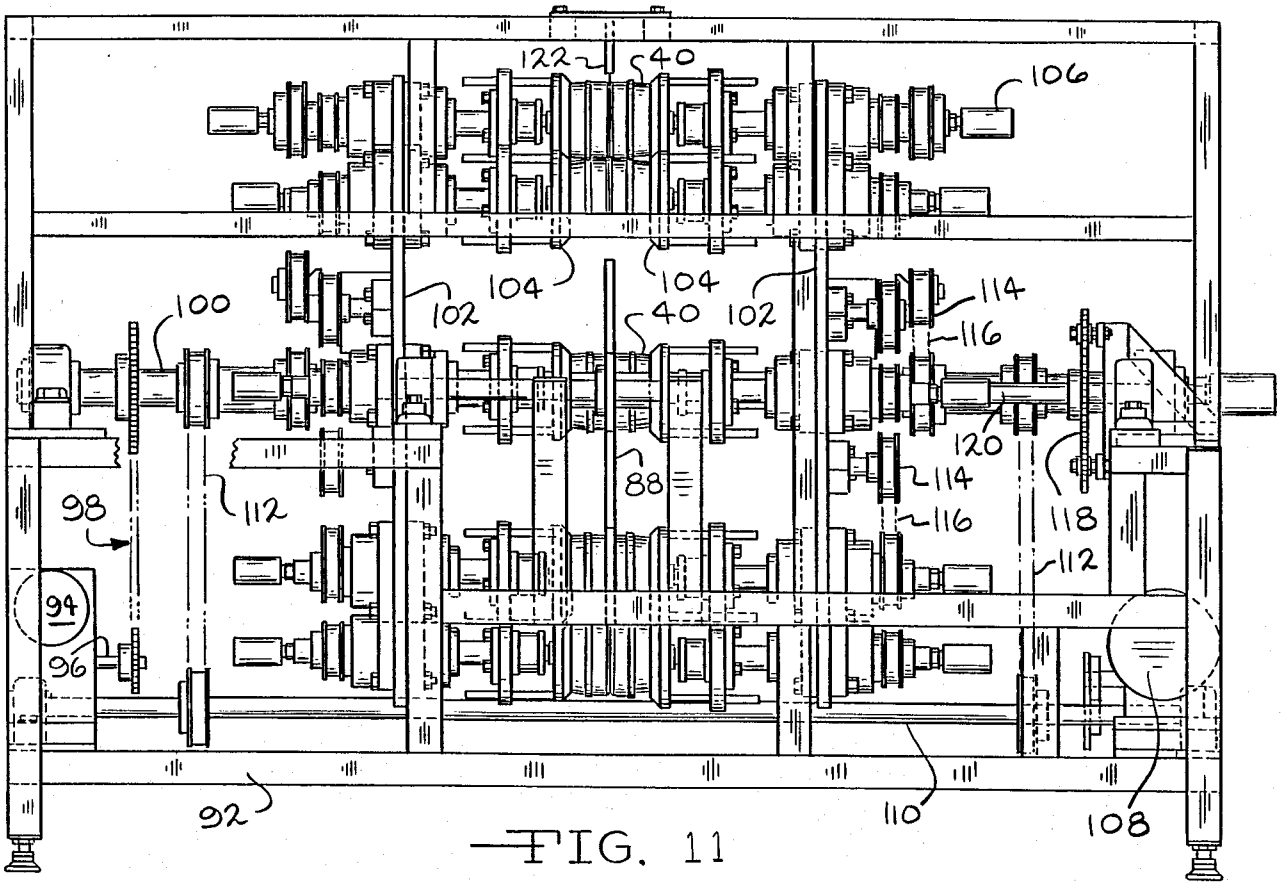
FIG. 11 is a front view of the slitting apparatus shown in FIG. 10.

The slitter assembly 86 also includes a main frame 92 on which a main drive motor 94 is mounted. The motor 94 has a drive shaft 96 which drives a chain and sprocket assembly 98 which in turn drives the main drive shaft 100 which drives the carryier wheel 90. The wheel 90 includes a pair of side plates 102 on which camp heads 104 are mounted for engaging opposite end walls 42 of the blow molded body 40. Actuating cylinders 106 are provided for moving the heads 104 away from each other to release a body 40 and toward each other to clamp a part 40 therebetween as illustrated in FIG. 11.

A drive motor 108 is mounted on the frame 92 for rotating the heads 104. The motor 108 drives a shaft 110 which in turn drives pulley and belt assemblies 112 which in turn drive pulleys 114 which are driven by belts 116, only portions of which are shown for purposes of clarity.

An auxiliary chain and sprocket assembly 118, driven by the main shaft 100, drives a shaft 120 which in turn drives the feeder wheel 88.

Figure 12A:
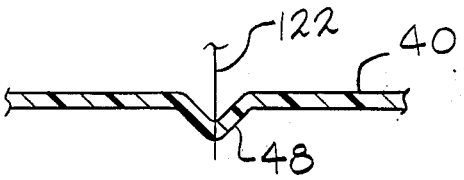
FIG. 12A is an enlarged detail sectional view of a portion of the apparatus shown in FIG. 12.

A slitter knife 122 is mounted in a fixed position on the upper portion of the frame 92 for engagement with the molded bodies 40 that are being concurrently rotated about their own axes longitudinal and about the axis of the main drive shaft 100. The slitter knife 122 is located in line with the grooves 48 in the bodies 40 midway between the ends of the groove, as illustrated in FIG. 12*a*. The result is a clean slitting of each body 40 so as to divide it into a pair of base cups 20. As shown in FIG. 11, the bodies 40 are slit and divided during their travel past the slitter knife 122 at the upper end of the frame 92. When the divided bodies 40 reach the lower part of their travel, adjacent the lower end of the frame 92, the heads 104 are moved apart by the cylinders 106 so as to release the thus formed base cups 20. When the heads 104 are horizontally aligned with the next body 40 on the feeder wheel 88, they are moved toward each other by the cylinder 106 so as to grip the body 40 therebetween as shown in FIG. 11, and transfer the body from the feeder wheel 88 to the carrier wheel 90. The holes 28 in the bottom wall of the base cup 20 can be conveniently formed while the base cups are on the slitter assembly 86 or can be formed after they are removed from the slitter assembly 86.

Figure 4A:
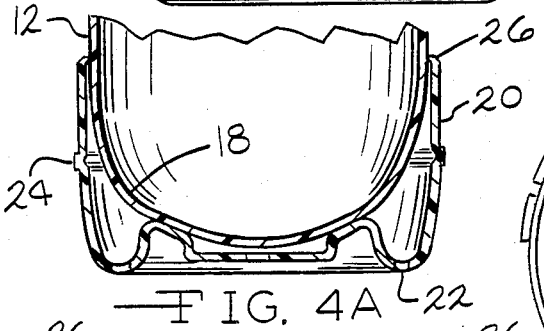
FIG. 4A is a fragmentary sectional view showing the base cup of this invention with the base portion of the bottle nested therein.

The base cups 20 are then arranged in stacks 32 in which the de-nesting rings 24 enable easy removal of the base cups 20 in a one by one manner from the stack 32. The base cups are then assembled with the bottles 12 as shown in FIGS. 1 and 4a and secured by adhesive in the assembled positions. In these positions, the sealing lip 26 on the upper rim of each base cup 20 engages the bottle side wall 16 so as to prevent fluid from entering the upper end of the base cup. In the event fluid does enter the base cup, it is readily drained therefrom through the openings 28.

From the above description it is seen that this invention provides improved base cups 20 and 20*a* along with an improved method and apparatus for manufacturing the base cups.

I claim:

1. A composite container comprising an upright plastic bottle having a generally cylindrical side wall and a cup-shape base portion, a cup-shape base cup member telescoped upwardly over said bottle base portion and arranged in a supporting relation with said bottle, said base cup being formed of blow molded plastic and having a planar bottom portion shaped to sit on a horizontal surface and an upwardly extending tubular wall which terminates at its upper end in an annular rim engaged with said cylindrical bottle side wall, said tubular base cup wall being formed substantially midway between its bottom portion and upper rim with outwardly extending projection means symmetrical with respect to said base cup and having a flat bottom surface extending radially outwardly beyond said rim, said projection means being operable to limit the extent to which an upper and lower pair of said base cups can be nested one within the other with the bottom surface of the projection means on the upper cup engaging the uppermost surface on the lower cup, said surface constituting the rim.

2. The container according to claim 1 wherein said uppermost surface of said annular rim of said base cup tubular wall terminates in an inwardly and upwardly inclined annular sealing lip engaged with said cylindrical bottle side wall to thereby deflect water or other fluid flowing downwardly on said bottle side wall along the outer surface of said base cup to prevent the accumulation of water or other fluid in said base cup.

3. The container according to claim 1 wherein said projection means comprises an annular ring extending around said base cup.

4. The container according to claim 1 wherein said projection means comprises embossing on said base cup wall.

5. The container according to claim 3 further including means forming a plurality of drain holes in said base cup.

* * * * *